US006394369B2

(12) United States Patent
Goenka et al.

(10) Patent No.: US 6,394,369 B2
(45) **Date of Patent: *May 28, 2002**

(54) NOZZLE

(75) Inventors: Lakhi Nandial Goenka, Ann Arbor; Malgorzata M. Skender, Birmingham, both of MI (US)

(73) Assignee: Visteon Global Tech., Inc., Dearborn, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/470,135

(22) Filed: Dec. 22, 1999

(51) Int. Cl.[7] ..... B05B 1/26

(52) U.S. Cl. ..... 239/601; 239/589; 239/590; 239/592; 239/594; 239/597

(58) Field of Search ..... 239/589, 590, 239/592, 594, 597, 599, 601, DIG. 14

(56) References Cited

U.S. PATENT DOCUMENTS

| | | | | | |
|---|---|---|---|---|---|
| 577,362 | A | * | 2/1897 | Ettlinger | 239/592 X |
| 1,186,117 | A | * | 6/1916 | Moe | 239/592 X |
| 1,239,373 | A | * | 9/1917 | Farmer et al. | 239/594 |
| 1,709,167 | A | * | 4/1929 | Dwyer, Jr. | 239/601 X |
| 2,026,743 | A | * | 1/1936 | Kurtz | 239/594 |
| 2,561,443 | A | * | 7/1951 | March | 239/592 X |
| 2,945,739 | A | * | 7/1960 | Lehmicke | 239/601 X |
| 3,195,819 | A | * | 7/1965 | Watanabe | 239/601 |
| 3,474,746 | A | * | 10/1969 | Hiniker | 239/597 |
| 4,487,366 | A | * | 12/1984 | Davis et al. | 239/11 |
| 4,960,245 | A | * | 10/1990 | Hemmat | 239/597 |
| 5,284,554 | A | | 2/1994 | Datta et al. | |
| 5,445,185 | A | | 8/1995 | Watanabe et al. | |
| 5,545,073 | A | | 8/1996 | Kneisel et al. | |
| 5,566,703 | A | | 10/1996 | Watanabe et al. | |
| 5,571,562 | A | * | 11/1996 | Wakat | 427/280 |
| 5,662,968 | A | * | 9/1997 | Yamaguchi | 427/421 |
| 5,679,062 | A | | 10/1997 | Goenka et al. | |
| 5,815,181 | A | | 9/1998 | Kashino et al. | |
| 5,836,150 | A | | 11/1998 | Garcia | |
| 5,868,323 | A | * | 2/1999 | Cantor | 239/601 X |
| 5,901,908 | A | | 5/1999 | Goenka et al. | |
| 5,920,013 | A | | 7/1999 | Boardman et al. | |
| 6,070,811 | A | * | 6/2000 | Takeda et al. | 239/601 X |

FOREIGN PATENT DOCUMENTS

| | | | | |
|---|---|---|---|---|
| GB | 2152847 | * | 8/1985 | 239/590 |

* cited by examiner

*Primary Examiner*—Robin O. Evans
(74) *Attorney, Agent, or Firm*—Visteon Global Technologies, Inc

(57) ABSTRACT

A nozzle 10 having a material outlet aperture 24 which causes received material 28 to be emitted in the form of a streaming sheet 30.

3 Claims, 4 Drawing Sheets

NOZZLE

FIELD OF THE INVENTION

This invention relates to a nozzle and more particularly, to a nozzle which selectively emits a streaming sheet of material, thereby allowing the emitted material to be selectively deposited upon a surface and/or upon a targeted location in a desired manner.

BACKGROUND OF THE INVENTION

Nozzles selectively emit various types of materials, such as and without limitation, paint, thereby allowing the selectively emitted material to be placed or deposited upon various objects and/or upon one or more "targeted" locations in some desired pattern and/or concentration.

It is oftentimes desirable to cause the deposited material to form or include substantially "well-defined", relatively straight, "crisp", and/or substantially "clean" edges and/or borders in order to allow the deposited material to create an overall aesthetically pleasing appearance and/or to substantially increase the likelihood that only portions of the targeted location(s) or object(s) actually receive the emitted material. For example, vehicle paint striping should normally have well defined and relatively straight edges in order to properly enhance the overall appearance of the vehicle. Moreover, vehicle striping having multi-color (e.g., two or more) paint portions require the creation of relatively straight edges and/or a substantially "clean" interface between each of the applied colored materials in order to provide the desired overall striping appearance.

While prior nozzles and nozzle assemblies selectively emit material and allow the selectively emitted material to be placed upon various objects and/or targeted locations, they do not readily provide these desired well-defined edges due to the creation and/or existence of a relatively turbulent "shear layer" of material which typically occurs at and/or along the edges of the emitted material.

There is therefore a need for a new and improved nozzle which allows material to be selectively emitted and deposited upon a targeted location and/or object, which allows the selectively deposited material to form substantially well-defined and/or substantially "crisp", relatively straight and/or substantially "clean" edges; which allows the deposited material to form and/or to provide an overall aesthetically pleasing appearance; and which substantially increases the likelihood that the selectively deposited material is deposited upon a targeted object and/or location.

SUMMARY OF THE INVENTION

It is a first object of the invention to provide a nozzle which overcomes some or all of the previously delineated disadvantages of prior nozzles and/or nozzle assemblies.

It is a second object of the invention to provide a nozzle which overcomes some or all of the previously delineated disadvantages of prior nozzles and nozzle assemblies and which includes an outlet aperture having a shape which is effective to cause the emitted material to form a streaming sheet.

It is a third object of the invention to provide a nozzle which overcomes some or all of the previously delineated disadvantages of prior nozzles and of prior nozzle assemblies and which includes an outlet aperture having a shape which is effective to cause the emitted material to form a streaming sheet, thereby allowing the selectively emitted material to be deposited upon an object and/or location in an aesthetically pleasing manner.

According to a first aspect of the present invention a nozzle is provided having an outlet aperture of a certain shape which causes selectively emitted material to form a streaming sheet.

These and other aspects, features, and advantages of the invention will become apparent from a reading of the following detailed description of the preferred embodiment of the invention, by reference to the attached claims, and by reference to the attached drawings.

DETAILED DESCRIPTION OF THE PREFERRED EMBODIMENT OF THE INVENTION

Figure 1:
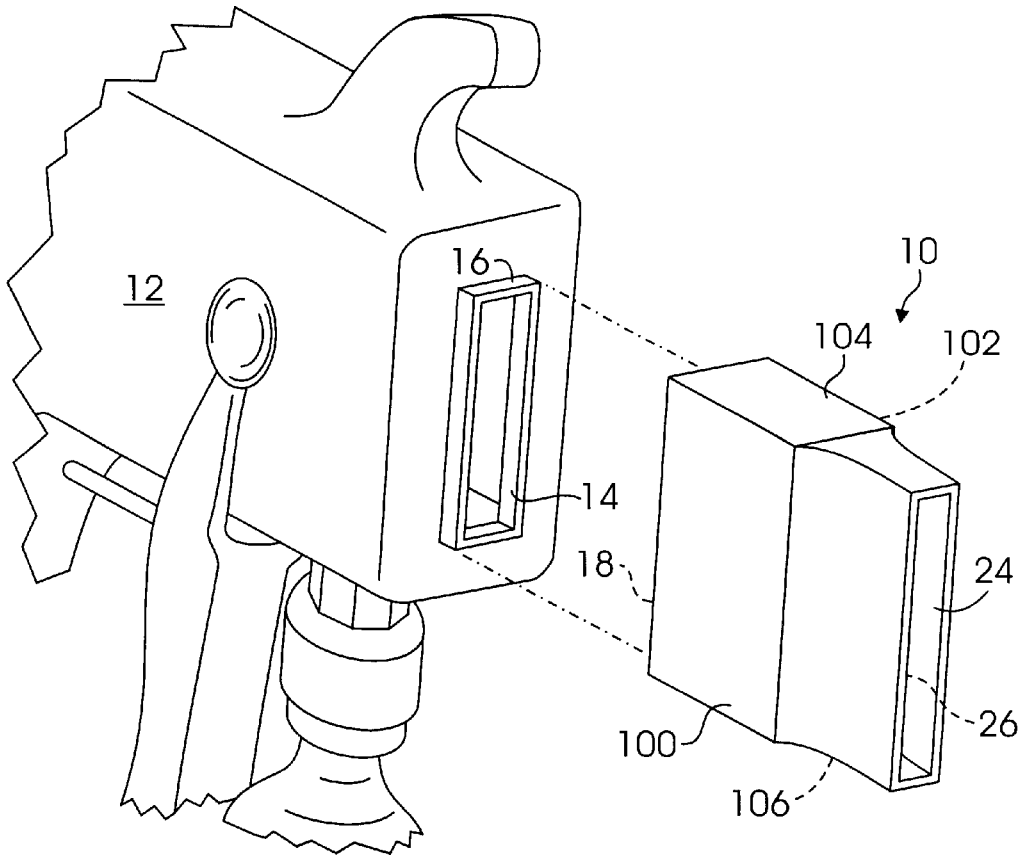
FIG. 1 is a perspective view of a nozzle which is made in accordance with the teachings of the preferred embodiment of the invention and which is shown in unassembled combination with a conventional material emitter.

Referring now to FIGS. 1–4, there is shown a nozzle 10 which is made in accordance with the teachings of the preferred embodiment of the invention. Particularly, nozzle 10 is substantially hollow and is preferably of a "uni-body" or "uni-member" design and is adapted for use with a conventional material emitter or "gun" 12 having a pressurized material outlet aperture 14 which extends through and is formed within a generally rectangular flange portion 16. Other types and/or shapes of apertures 14 and flange portions 16 may be utilized. Moreover, other types of material emitters may similarly be utilized in a manner consistent with the teachings of the preferred embodiment of the invention.

Particularly, nozzle 10 includes a first inlet aperture 18 which may be of any desired shape and/or size and which is selectively and communicatively coupled to and which operatively overlays the pressurized material outlet aperture 14. Particularly, the flange portion 16 is selectively and removably received within opposed notches 20, 22 of nozzle 10, thereby removably securing nozzle 10 to member or "gun" 12. Other methods and/or techniques of removably securing nozzle 10 to emitter 12 may be utilized and, in other alternate non-limiting embodiments of the invention, nozzle 12 may be integrally formed within emitter 12.

Nozzle 10 further includes and/or forms an outlet aperture 24 which may be of a selected size and shape and a material reception cavity 26 which communicates with apertures 18 and 24. In operation, material 28 is communicated to cavity 26, through the inlet aperture 18, by the material emitter 14. The material 28 traverses cavity 26 and exits the nozzle 10 through the outlet aperture 24, in accordance with the principles and the teachings of the invention. In a further non-limiting embodiment, nozzle 10 or selected portions of nozzle 10 may be formed by a silicon micro-machining process.

In the preferred embodiment of the invention, the outlet aperture 24 comprises a generally rectangular shape which causes the emitted material 28 to form a substantially streaming sheet 30 which allows for the selective placement of material 28 upon a targeted location and/or object and which further allows for the creation of substantially "sharp", "crisp", "straight", and aesthetically pleasing edges.

Figure 6:
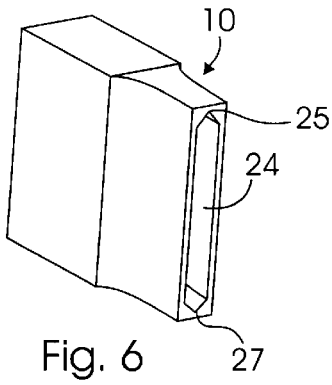
FIG. 6 is a perspective view of a nozzle which is made in accordance with the teachings of a third embodiment of the invention.
Figure 7:
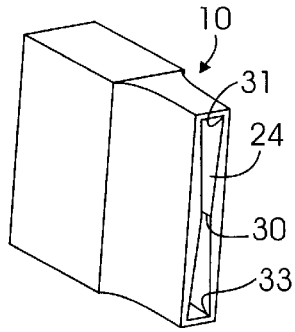
FIG. 7 is a perspective view of a nozzle which is made in accordance with the teachings of a fourth embodiment of the invention.
Figure 8:
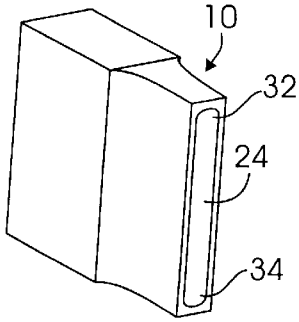
FIG. 8 is a perspective view of a nozzle which is made in accordance with the teachings of a fifth embodiment of the invention.

In a second embodiment of the invention, as best shown in FIG. 6, the outlet aperture 24 is substantially "diamond shaped" (i.e., having substantially identical tapered end portions 25, 27), and in a third embodiment of the invention, as best shown in FIG. 7, the outlet aperture 24 is substantially "hour-glass" or "bow tie" shaped (i.e., having a relatively constricted middle or central portion 30 and substantially identical expanded end portions 31, 33). In yet a fourth embodiment of the invention, as best shown in FIG. 8, the outlet aperture 24 is substantially oval in shape and/or is substantially similar to the shape which is shown in FIG. 1 but having substantially similar rounded end portions 32, 34. Each of these diverse aperture configurations effectively allow the streaming sheet 30 of material 28 to be selectively generated.

Figure 9:
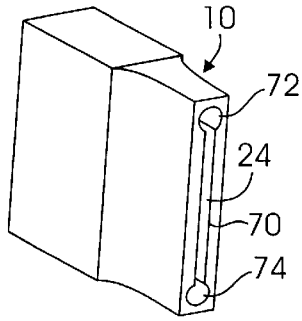
FIG. 9 is a perspective view of a nozzle which is made in accordance with the teachings of a sixth embodiment of the invention.

In yet another non-limiting embodiment of the invention, which is shown best in FIG. 9, the outlet aperture 24 is substantially "barbell" shaped. In this embodiment, aperture 24 has a substantially rectangular first or central/middle portion 70 which integrally terminates within and/or forms substantially identical and generally rounded opposed end portions 72, 74. This "barbell" configuration is particularly useful when one considers that the surface tension of the emitted material 28 is inversely proportion to the width of the aperture 24. An increase of the surface tension of the emitted material 28 tends to make the sheet coalesce or collapse. Hence, the flared end portions 72, 74 are effective to reduce the surface tension of the emitted material 28 along the outer edges 90, 92, thereby delaying the collapse of the emitted spray pattern or sheet 30 of material 28.

As should be appreciated by those of ordinary skill in the art, that each of these various and previously delineated embodiments of aperture 24, as shown in FIGS. 1 and 6–9, require that aperture 24 be continuous and substantially "uninterrupted". That is, a turbulent sheet of material 30 may be achieved by the use of several or an array of generally circular material emission apertures. However, these generally circular emission apertures form "gaps" and distortion along and/or at their respective abutting and/or interfacing edges, thereby undesirably distorting and/or creating the turbulence within the selectively formed sheet of material and undesirably preventing the creation of a steaming sheet of material. The continuous and substantially "uninterrupted" nature of the aperture 24, in all of the previously delineated embodiments, therefore substantially eliminates this turbulence drawback and desirably allows a streaming sheet of material to be formed.

Figure 5:
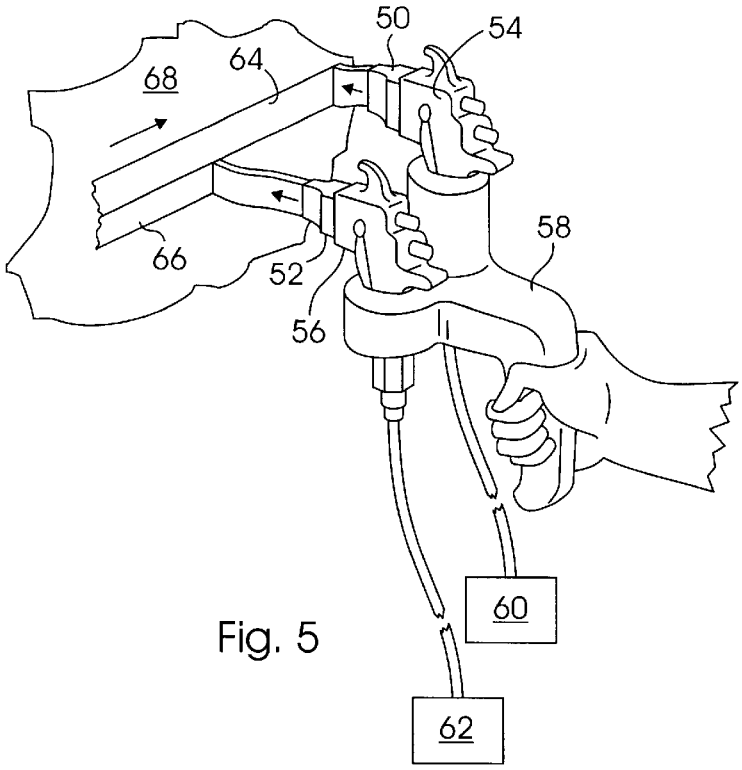
FIG. 5 is a perspective view of a nozzle assembly which is made in accordance with the teachings of a second embodiment of the invention.

In another non-limiting embodiment of the invention, as best shown in FIG. 5, a pair of nozzles 50, 52 are communicatively and operatively coupled to respective material emitters or "guns" 54, 56. Each emitter 54, 56 is attached to and/or is integrally formed with a single handle or member 58, and each emitter 54, 56 is respectively coupled to a source of material 60, 62. Member 58 causes emitters 54, 56 to concomitantly move and, by use of nozzles 50, 52 (which may each form one of the previously delineated nozzles 10), form respective colored strips 64, 66 upon a targeted location and/or object 68. In yet another alternate embodiment of the invention, the movement of the material emitters 54, 56 may occur by and/or under computer control.

Figure 2:
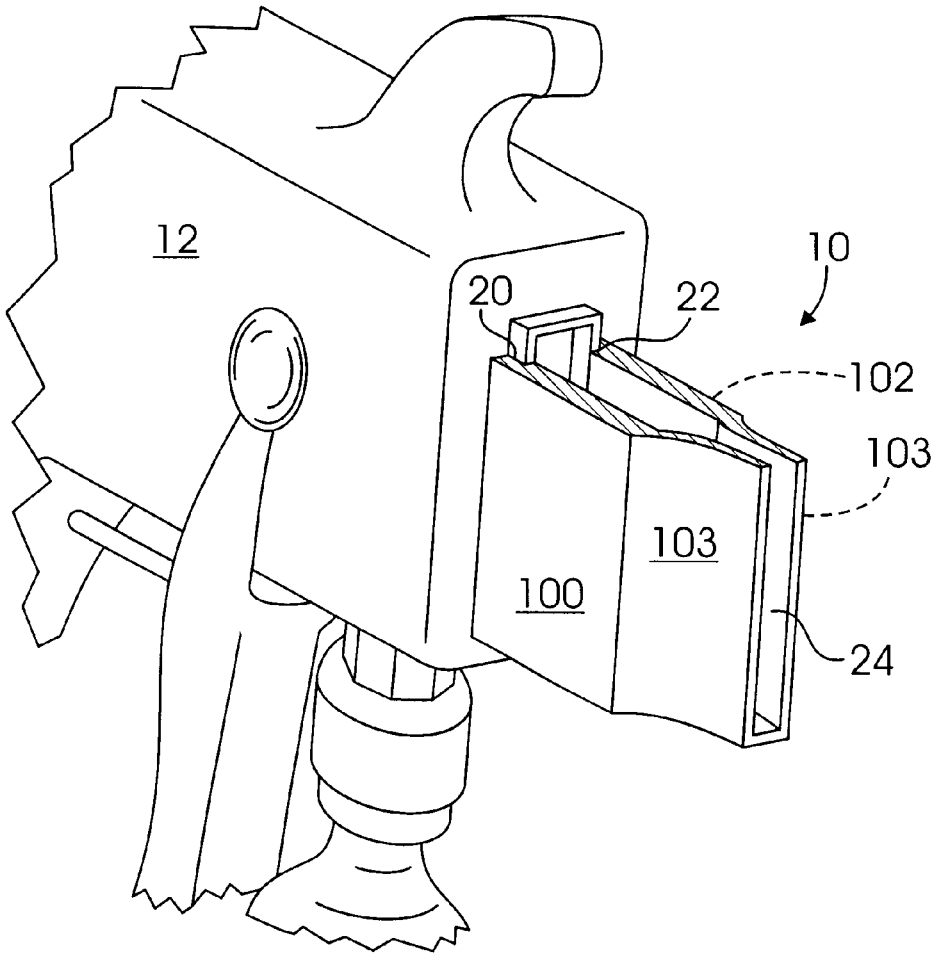
FIG. 2 is an assembled partial view of the nozzle which is shown in FIG. 1 in combination with the conventional material emitter which is also shown in FIG. 1.
Figure 3:
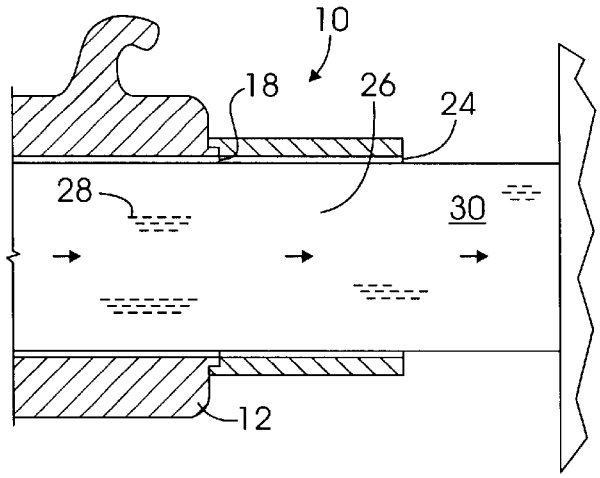
FIG. 3 is a side sectional view of the nozzle and material emitter combination which is shown in FIG. 2 and further showing the selective emission of a streaming sheet of material.
Figure 4:
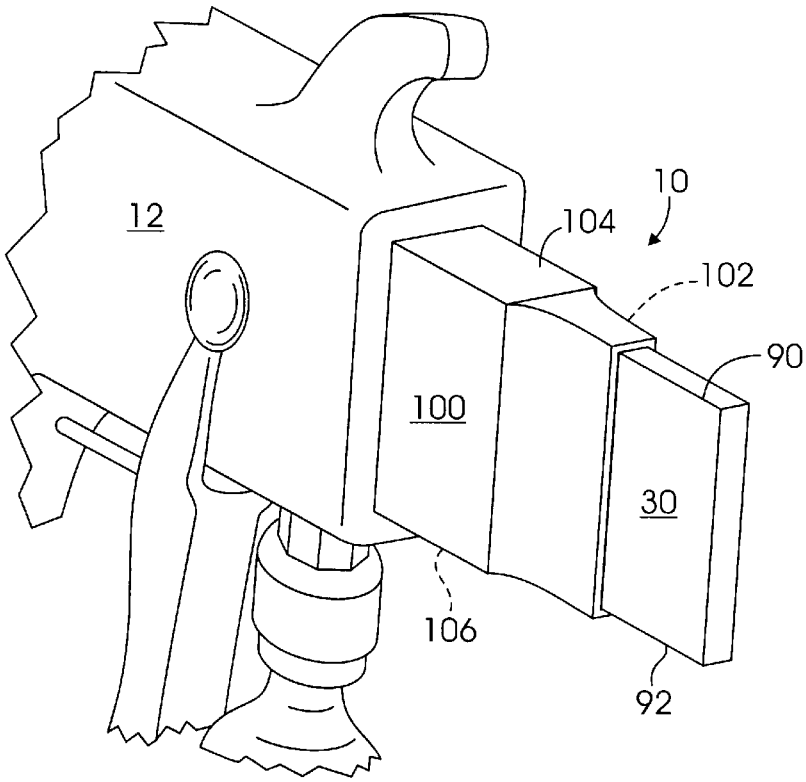
FIG. 4 is a perspective view of the combination which is shown in FIG. 3.

In yet another non-limiting embodiment, which is best shown in FIGS. 1, 2, and 4, the sidewalls 100, 102 or a portion 103 of the sidewalls 100, 102 of nozzle 10 converge or taper along a direction beginning at the inlet aperture 18 and ending at and/or within the outlet aperture 24. A similar convergence of the top and bottom walls 104, 106 may also occur. This convergence allows the formed sheet 30 to maintain a desired amount of surface tension, thereby substantially preventing the collapse and/or dispersion of the sheet 30 before the sheet 30 impinges upon a target location and/or object.

It is to be understood that the invention is not limited to the exact construction and method which has been illustrated and described above, but that various changes and modifications may be made without departing from the spirit and the scope of the various inventions which are set forth in the following claims.

What is claimed is:

1. A nozzle having an elongated inlet portion which receives material, a substantially uniform cavity which communicates with said inlet portion, an outlet portion having a tapered top wall, tapered sidewalls, a tapered bottom wall and an outlet aperture which communicates with said cavity, said outlet aperture being barbell shaped which causes said material to be emitted in a streaming sheet and which includes flared end portions which are effective to reduce the surface tension of the emitted material along its outer edges, thereby delaying the collapse of the emitted material.

2. A nozzle having an inlet aperture which selectively receives material and a continuous elongated material emission portion which communicates with said inlet aperture, which has converging sidewalls, a converging top wall, and a converging bottom wall, and which has a barbell shaped outlet aperture which is effective to cause said received material to form a streaming sheet, said barbell shaped outlet aperture including flared portions which are effective to reduce the surface tension of the emitted material along its outer edges, thereby delaying the collapse of the emitted material.

3. A nozzle assembly comprising a first nozzle which receives a first material through a first inlet aperture and which includes an outlet portion having tapered sidewalls, a tapered bottom wall, a tapered top wall, and a having barbell shape which causes said received first material to be emitted in the form of a first steaming sheet, said material outlet aperture including flared end portions which are effective to reduce the surface tension of the emitted first material along its outer edges, thereby delaying the collapse of the emitted first material; and a second nozzle which receives a second material through a second inlet aperture and which includes a second continuous material outlet aperture of uniform length having a second barbell shape, which causes said received second material to be emitted in the form of a second streaming sheet, said second outlet aperture including flared end portions which are effective to reduce the surface tension of the emitted second material along its outer edges, thereby delaying the collapse of the emitted material.

* * * * *